US010961827B2

(12) United States Patent
Daly

(10) Patent No.: US 10,961,827 B2
(45) Date of Patent: Mar. 30, 2021

(54) TUBING CONVEYED PERFORATING SYSTEM WITH SAFETY FEATURE

(71) Applicant: Expro Americas, LLC, Houston, TX (US)

(72) Inventor: Kerry G. Daly, Conroe, TX (US)

(73) Assignee: Expro Americas, LLC, Houston, TX (US)

( * ) Notice: Subject to any disclaimer, the term of this patent is extended or adjusted under 35 U.S.C. 154(b) by 361 days.

(21) Appl. No.: 15/667,223

(22) Filed: Aug. 2, 2017

(65) Prior Publication Data

US 2019/0040723 A1 Feb. 7, 2019

(51) Int. Cl.

| | |
|---|---|
| ***E21B 43/1185*** | (2006.01) |
| ***F41A 19/13*** | (2006.01) |
| ***F42B 3/10*** | (2006.01) |
| ***F42C 15/44*** | (2006.01) |

(52) U.S. Cl.

CPC ..... *E21B 43/1185* (2013.01); *F41A 19/13* (2013.01); *F42B 3/10* (2013.01); *F42C 15/44* (2013.01)

(58) Field of Classification Search

CPC ..... E21B 43/1185; F41A 19/13; F42B 3/10; F42C 15/44

USPC ..... 89/1.15

See application file for complete search history.

(56) References Cited

U.S. PATENT DOCUMENTS 3,056,226 A * 10/1962 Hubbard ..... F41A 19/13 42/69.02
3,645,166 A * 2/1972 Plumer ..... F41A 3/74 89/26
4,509,604 A * 4/1985 Upchurch ..... E21B 43/11852 175/4.52
4,566,544 A * 1/1986 Bagley ..... E21B 43/11855 166/297
4,969,525 A * 11/1990 George ..... E21B 43/116 102/319
5,052,489 A * 10/1991 Carisella ..... E21B 43/1185 166/297
5,115,865 A * 5/1992 Carisella ..... F42D 1/04 166/297
5,223,665 A * 6/1993 Burleson ..... E21B 43/11855 102/312
5,603,384 A * 2/1997 Bethel ..... E21B 43/11855 175/4.54
5,680,905 A * 10/1997 Green ..... E21B 43/11852 175/4.54

(Continued)

FOREIGN PATENT DOCUMENTS

| | | |
|---|---|---|
| DE | 19539812 A1 | 4/1997 |
| WO | 2017146849 A1 | 8/2017 |

OTHER PUBLICATIONS

International search report for PCT/US2018/044481 dated Nov. 7, 2018.

*Primary Examiner* — Joshua E Freeman
*Assistant Examiner* — Bridget A Cochran
(74) *Attorney, Agent, or Firm* — Getz Balich LLC

(57) ABSTRACT

A tubing conveying perforating system with a firing head is provided, and a method for using the same is provided. The firing head includes a firing pin and a percussion initiator. The firing pin is configured to degrade over a predetermined period of time from an initial state to a degraded state, and in the degraded state the firing head is inoperable.

16 Claims, 3 Drawing Sheets

(56) References Cited

U.S. PATENT DOCUMENTS

| | | | | |
|---|---|---|---|---|
| 6,722,424 | B2 * | 4/2004 | Broad | E21B 43/11852 166/297 |
| 8,079,296 | B2 * | 12/2011 | Barton | E21B 43/1185 89/1.15 |
| 8,851,160 | B2 | 10/2014 | Stolboushkin | |
| 9,470,071 | B2 * | 10/2016 | Morrison | F24D 1/04 |
| 9,540,913 | B2 * | 1/2017 | Moore | E21B 43/11852 |
| 10,180,049 | B1 * | 1/2019 | Trafton | E21B 43/1185 |
| 2002/0134272 | A1 * | 9/2002 | Pipkin | F42B 33/06 102/416 |
| 2013/0112429 | A1 * | 5/2013 | Crews | C09K 8/52 166/376 |
| 2013/0126167 | A1 * | 5/2013 | Stolboushkin | E21B 43/11855 166/297 |
| 2013/0327540 | A1 * | 12/2013 | Hamid | E21B 33/12 166/376 |
| 2014/0202708 | A1 * | 7/2014 | Jacob | E21B 23/01 166/376 |
| 2015/0007994 | A1 * | 1/2015 | Lancaster | E21B 43/1185 166/297 |
| 2016/0201425 | A1 * | 7/2016 | Walton | E21B 33/1208 166/376 |
| 2016/0273300 | A1 * | 9/2016 | Walton | E21B 33/16 |
| 2017/0211363 | A1 * | 7/2017 | Bradley | F42B 3/08 |
| 2017/0247977 | A1 * | 8/2017 | Hardesty | E21B 34/06 |
| 2017/0247996 | A1 * | 8/2017 | Hardesty | E21B 41/00 |
| 2019/0127290 | A1 * | 5/2019 | Lohken | C06B 41/00 |

* cited by examiner

TUBING CONVEYED PERFORATING SYSTEM WITH SAFETY FEATURE

CROSS-REFERENCE TO RELATED APPLICATIONS

None.

BACKGROUND OF THE INVENTION

1. Technical Field

This invention relates, in general, to a method and apparatus for perforating wells, and more particularly to tubing conveyed perforating systems with safety features.

2. Background Information

Without limiting the scope of the present invention, its background will be described with reference to perforating a hydrocarbon bearing subterranean formation with a shaped-charge perforating gun, as an example.

After drilling the section of a subterranean well bore that traverses a hydrocarbon bearing subterranean formation, individual lengths of metal tubular casings are typically secured together to form a casing string that is positioned within the well bore. The casing string increases the integrity of the well bore and provides a path through which fluids from the formation may be produced to the surface. Conventionally, the casing string is cemented within the well bore.

To produce fluids into the casing string, the casing string may be perforated with a perforating gun containing multiple shaped explosive charges actuated by a firing head. A variety of different firing heads and perforating guns are known in the prior art. In some embodiments, when the firing head is actuated, a primary explosive is detonated and ignites a booster charge connected to a primer cord. The primer cord transmits a detonation wave to the shaped charges, which are activated to create explosive gas jets for penetrating well casing and the surrounding geologic formations.

It is known that perforating guns and associated apparatus can be configured as an electric wireline perforating ("EWP") system or a tubing conveyed perforating ("TCP") system. Each of these systems, as they are known in the prior art, has advantages and disadvantages. EWP systems utilize electrical detonators that may be initiated by an electrical signal. Because an electrical signal is used to initiate detonation, it is critical that all well equipment, including the wellhead, derrick and logging unit, be properly grounded before perforating operations are started. To avoid inadvertent detonation, electrical detonators should not be utilized during electrical or static-generating dust storms. Moreover, perforating operations involving electrical detonators should not be performed while a mobile transmission set (e.g., a radio or telephone) is in operation within a predetermined distance of the well and/or a perforation truck.

In view of potential safety issues associated with EWP systems, TCP systems are often preferred in the industry. TCP systems require hydraulic pressure and/or mechanical force in order to initiate the perforating gun, which eliminates accidental electrical firing from, for example, stray voltage from cathodic protection (low voltage electrical source between well head, casing, and fluids to prevent corrosion), or surface power generation (cell phone or radio transmission, overhead lines, or welding), or lighting strike, among others. TCP systems allow the attachment of firing heads after the perforating guns are positioned in the well bore. In fact, recommended safety practices (as established by API RP67) for TCP systems include the use of a minimum 10-ft safety spacer to be run at the top of the perforating gun string, between the firing head and first loaded charge, so that the guns are positioned below ground level before installing the firing head. In contrast, EWP systems typically require the wiring and/or installing of an electrical detonator on the surface, making these type EWP perforating guns "live" on the surface. TCP system firing head explosive components are also typically designed with additional safety features to prevent accidental firing, such as minimum no-fire impact requirements and matched geometry of the firing pin and a percussion initiator.

An example of a TCP system is one that includes a mechanical firing head ("MFD"); e.g., a firing head designed to actuate upon impact from a dropped device (often referred to as a "drop bar"). In these systems, a drop bar is typically dropped within the TCP string at the appropriate moment. Gravity forces the drop bar downward and into contact with a firing head. There are several different firing heads known in the prior art. For example, the firing head may have a firing pin (or other mechanical element) mechanically held in place (e.g., by one or more shear pins). When the drop bar is dropped, the drop bar will impact a structural element (e.g., a firing piston assembly) portion of the firing head that is either connected with the firing pin or impacts the firing pin. The force of the impact shears the shear pin(s) heretofore holding the firing pin in place. The firing pin is thereby actuated to engage a percussion initiator, which in turn actuates the perforating gun to create the casing perforations. Some prior art TCP systems utilize a safety firing head (sometimes referred to as "safety mechanical firing head", or "SMFD"), that uses hydraulic pressure to positionally lock the firing pin rather than a shear pin. In these SMFD devices, once certain conditions are met (e.g., sufficient hydraulic pressure within the well bore), the firing pin is unlocked and can be actuated by a drop bar.

While TCP systems have been proven relatively safe over time, there is nonetheless value in improving the safe operation of TCP systems. For example, a TCP system that utilizes a mechanical firing head can encounter a scenario wherein a drop bar is dropped to impact a firing head, but the firing head does not initiate and the perforating gun does not cause perforation of the casing string. There are several potential reasons that such a failure may occur, including: a collapse in the tubing used to convey the TCP guns to proper depth; a shoulder inside the tubing (e.g., a no-go if installed incorrectly); fill from pipe scale; fill from drilling mud when solids come out of suspension (water-based mud); the drop bar impacts the firing pin, but the shear pin holding the firing pin does not shear due to improper assembly or insufficient energy; the drop bar impacts the firing pin, but the firing pin is worn and therefore does not possess the proper geometry to cause initiation of the percussion initiator; the drop bar impacts the firing pin, and the firing pin impacts the percussion initiator, but the percussion initiator does not initiate, etc.

In those instances wherein a prior art firing head/perforating gun is defectively actuated, the uninitiated energetic material is a significant safety concern. The protocol in such instances typically is to retrieve ("fish") the drop bar using wireline conveyed retrieval equipment (sometimes referred to as a "pulling tool"). It is not, however, always possible to retrieve a drop bar in this manner. If it is not possible to retrieve the drop bar, then the entire unfired firing head/ perforating gun may be retrieved. In some instances, it is necessary to make a decision regarding whether to retrieve the unfired perforating gun with the drop bar still inside the firing head. Retrieval in this manner includes the risk that the unfired perforating gun may initiate at an unintended time, thus perforating the casing at an undesirable depth. Even if the drop bar is retrieved, the potential for unintended firing still exists.

SUMMARY OF THE INVENTION

According to an aspect of the present disclosure, a tubing conveying perforating system is provided. The system includes a perforating gun and a firing head. The firing head includes a housing, a firing pin and a percussion initiator. The firing pin is configured to degrade over a predetermined period of time from an initial state to a degraded state, and in the degraded state the firing head is inoperable.

According to another aspect of the present disclosure, a firing head is provided. The firing head includes a firing pin and a percussion initiator. The firing pin is configured to degrade over a predetermined period of time from an initial state to a degraded state, and in the degraded state the firing head is inoperable.

According to another aspect of the present disclosure, a method of operating a firing head is provided. The method includes: disposing a firing head in communication with a perforating gun within a casing string of a well bore, which well bore contains well bore fluids, wherein the firing head includes a firing pin and a percussion initiator, and wherein the firing pin is configured to degrade over a predetermined period of time from an initial state to a degraded state, and in the degraded state the firing head is inoperable; determining whether the firing head has failed to actuate the percussion initiator; and permitting an ingress of well bore fluid into the housing and in communication with the firing pin.

In any of the aspects and embodiments of the present disclosure, the firing pin may be configured to mate with the percussion initiator in the initial state, and does not mate with the percussion initiator in the degraded state.

In any of the aspects and embodiments of the present disclosure, the firing pin may include a protruding end surface, and the percussion initiator may include a depression, and the protruding end surface mates with the depression.

In any of the aspects and embodiments of the present disclosure, the protruding end surface may be substantially conically shaped, and the depression may be substantially conically shaped.

In any of the aspects and embodiments of the present disclosure, the firing pin may include a material that degrades by one or more of dissolution, erosion, swelling, chemical change, or electrochemical reaction when in contact with one or more well bore fluids.

In any of the aspects and embodiments of the present disclosure, the firing pin may include a material having a mechanical strength that decreases when in contact with one or more well bore fluids.

In any of the aspects and embodiments of the present disclosure, the firing head housing may include a port that is selectively openable to an open configuration, and in the open configuration is configured to allow an ingress of well bore fluid into the housing and in communication with the firing pin.

In any of the aspects and embodiments of the present disclosure, the housing may include a port sealed by a plug, and a step of permitting an ingress of well bore fluids into the housing may include maintaining the firing head within the casing string a period of time adequate for the plug to fail to an open configuration, and in the open configuration the port is configured to allow well bore fluids into the housing in communication with the firing pin.

In any of the aspects and embodiments of the present disclosure, the firing head housing may include a port sealed by a plug, and a step of permitting an ingress of well bore fluids into the housing may include creating a pressure within the casing string adequate to cause the plug to fail to an open configuration, and in the open configuration the port is configured to allow well bore fluids into the housing in communication with the firing pin.

In any of the aspects and embodiments of the present disclosure, the firing head housing may include a port sealed by a valve, and a step of permitting an ingress of well bore fluids into the housing may include creating a pressure within the casing string adequate to cause the valve to open and allow well bore fluids into the housing in communication with the firing pin.

DETAILED DESCRIPTION

Figure 1:
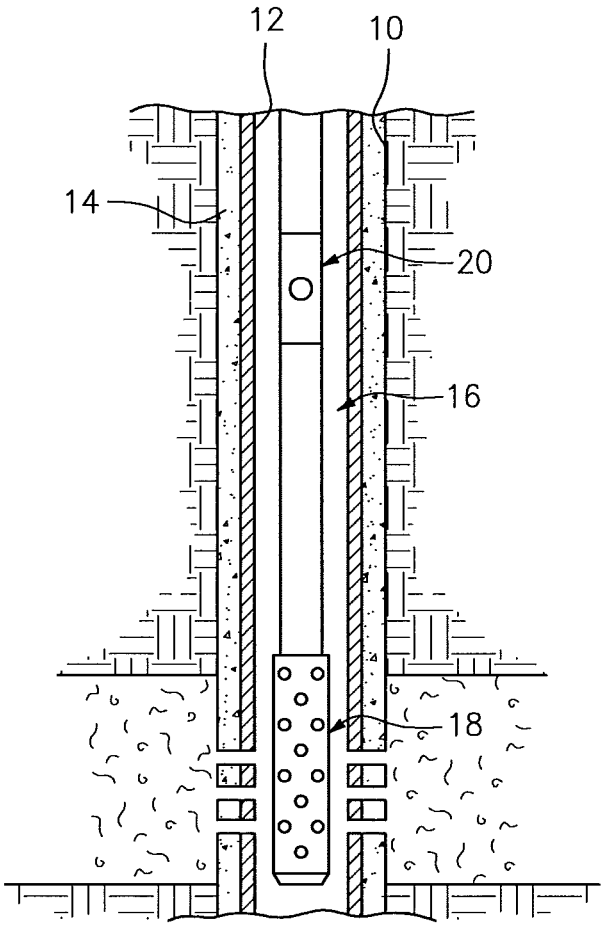
FIG. 1 is a diagrammatic view of a well bore including a tool string disposed within the casing string, which tool string includes a tubing conveying system having a firing head and a perforating gun.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present a method and/or process steps in a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

FIG. 1 diagrammatically illustrates an exemplary subterranean well bore 10 that traverses a hydrocarbon bearing subterranean formation. Metal tubular casings secured together to one another to form a casing string 12 that is positioned within the well bore. The casing string 12 increases the integrity of the well bore 10 and provides a path through which fluids from the formation may be produced to the surface. Conventionally, the casing string 12 is cemented 14 within the well bore 10. To permit the ingress of well bore fluids into the casing string 12, the casing string 12 may be perforated using a tubing conveyed perforating ("TCP") system 16 that includes a perforating gun 18 containing multiple shaped explosive charges actuated by a firing head 20. Well bore fluids can vary from well to well. Non-limiting examples of well bore fluids include aqueous solutions that may include salts, salt mixtures, hydrocarbon fluids, and in some instances may include drilling muds (sometimes referred to as "oil muds"). Embodiments of firing heads 20 that can be used within the present TCP system 16 are described below. The present disclosure, including the TCP system 16 aspects, can be used with a variety of different perforating guns 18. A variety of different type of perforating guns 18 are known within the prior art. For example, perforating guns come in a variety of different outer diameters, the number of shots per foot (sometimes referred to as "shot density"), having different circumferential shot phasing, having different magnitude charges to create different depth and size of penetration, etc. The present disclosure is not limited to use with any particular type or configuration perforating gun 18.

Aspects of the present disclosure include a TCP firing head 20 that can selectively be rendered inoperable, a TCP system 16 that uses such a firing head 20, and a method of operating such a firing head 20. In most embodiments, the present disclosure firing head 20 includes a housing 22, a firing pin 24, and a percussion initiator 26 (e.g., see FIGS. 2 and 3). The present disclosure is not limited to any particular firing head 20 configuration. Generally speaking, the firing head housing 22 extends lengthwise between a strike end 28 and an initiator end 30, and includes an interior cavity 32. The percussion initiator 26 is disposed at the initiator end 26 of the housing 22. The firing pin 24 includes a first end 34 and a second end 36. Prior to actuation, the firing pin 24 is typically disposed within the interior cavity 32 of the housing 22 with its second end 36 spaced a distance from the percussion initiator 26. During actuation, the firing pin 24 travels lengthwise within the housing 22 (e.g., upon a motive force provided directly or indirectly to the firing pin 24 by a drop bar) toward the percussion initiator 26, eventually contacting the percussion initiator 26. In an operable state, the firing pin 24 is configured to engage the percussion initiator 26 in a manner that will actuate the percussion initiator 26. In an inoperable state, the firing pin 24 is configured in a form that cannot actuate the percussion initiator 26.

In some embodiments of the present disclosure, the firing head 20 includes a firing pin 24 and a percussion initiator 26 having mating geometries; e.g., the percussion initiator may include a contact surface having a depression 38 (e.g., the female half of the mating pair) that mates with a protruding end surface 40 of the firing pin 24 (e.g., the male half of the mating pair). The percussion initiator 26 is configured such that under normal operating circumstances, the percussion initiator 26 will not detonate unless contacted with a firing pin 24 having a protruding end surface 40 that mates with the percussion initiator contact surface depression 38. In these embodiments, a portion of the firing pin 24 (e.g., the protruding end surface 40) comprises a degradable material that causes the portion of the firing pin 24 to change under certain well bore conditions (temperature, exposure to well bore fluids, etc.) from an initial geometry to a second geometry that cannot mate with the percussion initiator contact surface depression 38 in a manner adequate to cause the percussion initiator 26 to actuate. The change in geometry thus renders the TCP system 16 inoperable. In an alternative embodiment, the contact surface depression 38 of the percussion initiator 26 may include a degradable material that prevents actuation by the firing pin 24.

In some embodiments of the present disclosure, the firing head 20 includes a firing pin 24 that is configured to possess mechanical strength sufficient to impact the percussion initiator contact surface and cause initiation of the percussion initiator 26. In these embodiments, at least a portion of the firing pin 24 comprises a degradable material that causes the mechanical strength of at least a portion of the firing pin 24 to decrease to a point wherein the firing pin 24 no longer possesses mechanical strength sufficient to impact the percussion initiator contact surface and cause initiation of the percussion initiator 26.

The term "degradable material" as used herein may be any material that is configured to degrade by one or more mechanisms such as, but not limited to, dissolving, erosion, swelling, undergoing a chemical change, electrochemical reaction, or any combination thereof.

Degradation by swelling may involve absorption by the degradable material of aqueous fluids or hydrocarbon fluids present within the well bore environment such that the mechanical properties of the degradable material degrade or fail. In degradation by swelling, the degradable material absorbs the aqueous and/or hydrocarbon fluid until the firing pin 24 is no longer able to cause initiation of the percussion initiator 26; e.g., lacks mechanical strength or has changed geometry to a degree that it is no longer able to cause initiation of the percussion initiator 26.

Degradation by dissolving or eroding may involve a degradable material that is soluble or otherwise susceptible to an aqueous fluid or a hydrocarbon fluid, such that the aqueous or hydrocarbon fluid is not necessarily incorporated into the degradable material (as is the case with degradation by swelling), but the degradable material becomes soluble or erodes upon contact with the aqueous or hydrocarbon fluid and within a useful period of time the firing pin 24 is degraded to a degree that the firing pin 24 is no longer able to cause initiation of the percussion initiator 26.

Degradation by undergoing a chemical change may involve breaking the bonds of the backbone of the degradable material (e.g., a polymer backbone) or causing the bonds of the degradable material to crosslink, such that the degradable material becomes brittle and within a useful period of time the firing pin 24 is degraded to a degree that the firing pin 24 is no longer able to cause initiation of the percussion initiator 26.

The present disclosure is not limited to a material that degrades at any particular rate, as long as the rate of degradation (and therefore the minimum total amount of time) is useful for the application at hand. For most applications, a material that degrades an amount that is sufficient to make the firing head 20 inoperable within a maximum of about twenty four hours (24 hrs.) is acceptable. In some applications, a material that degrades an amount that is sufficient to make the firing head 20 inoperable within a range of time of about one to twelve hours (1-12 hrs.) is preferred. The aforesaid period of time necessary for adequate degradation may, of course vary depending on factors such as the type of degradable material selected, the conditions of the well bore environment, and the like.

Examples of acceptable degradable materials include borate glass, polyglycolic acid (PGA), polylactic acid (PLA), a degradable rubber, degradable polymers, galvanically-corrodible metals, dissolvable metals, dehydrated salts, thermoplastic polymers, and any combination thereof.

With respect to degradable polymers used as a degradable material, a polymer is considered to be "degradable" if the degradation is due to, in situ, a chemical and/or radical process such as hydrolysis, oxidation, or UV radiation. Degradable polymers, which may be either natural or synthetic polymers, include, but are not limited to, polyacrylics, polyamides, polyanhydrides, polyolefins (e.g., polyethylene, polypropylene, polyisobutylene, etc.), polyglycolic acid, and polylactic acid. With respect to galvanically-corrodible metals used as a degradable material, the galvanically-corrodible metal may be configured to degrade via an electrochemical process in which the galvanically-corrodible metal corrodes in the presence of an electrolyte (e.g., brine or other salt-containing fluids present within the well bore). Examples of galvanically-corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium.

As indicated above, aspects of the present disclosure can be used with a variety of different firing head 20 configurations and therefore is not limited to any particular configuration unless otherwise stated herein. To illustrate aspects of the present disclosure, a particular firing head 20 example is shown in FIGS. 2-5 and described below, but the present disclosure is not limited to this particular firing head 20 configuration.

FIGS. 2-5 illustrate an example of a firing head 20 that includes a housing 22, firing pin 24, a percussion initiator 26, and a firing piston assembly 42. The firing piston assembly 42 includes a slide rod 44, a slide rod yoke 46, and a firing pin collar 48. The second end 36 of the firing pin 24 includes a protruding end surface 40. The protruding end surface 40 has a substantially-conical exterior surface with a distal end 50. The distal end 50 is configured with a radius "R". The substantially-conical shape exterior surface is disposed at an angle "a" relative to the centerline 52 of the substantially-conical shaped protruding end surface 40. The slide rod 44 includes an impact head 54 disposed at a lengthwise end of a shaft 56. The slide rod yoke 46 is attached to the strike end 28 of the firing head housing 22, and includes a lengthwise bore 58 for receiving the slide rod shaft 56. In the embodiment shown in FIG. 2, the slide rod shaft 56 is received within the slide rod yoke bore 58 and may be fixed relative to the slide rod yoke 46 by a shear pin 60. The slide rod shaft 56 is engaged with one end of the firing pin collar 48. The first end 34 of the firing pin 24 is engaged with the firing pin collar 48. As stated above, the present disclosure can be used with a variety of different firing head 20 configurations and therefore is not limited to the particular firing head 20 configuration shown in FIGS. 2-5.

Figure 4:
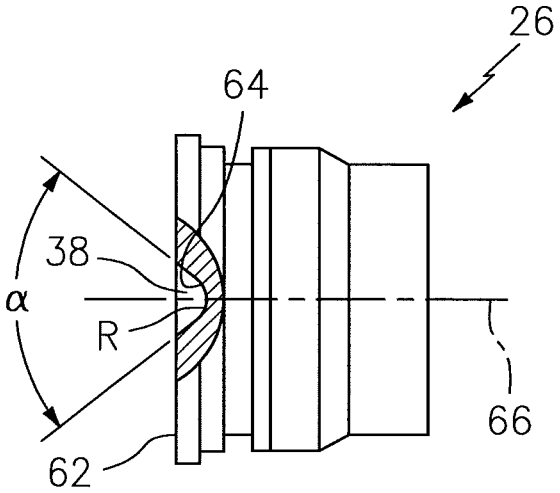
FIG. 4 is a diagrammatic partially sectioned view of a percussion initiator embodiment.
Figure 5:
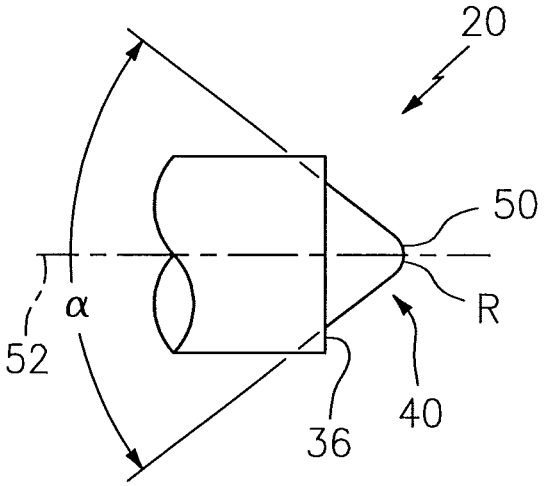
FIG. 5 is an enlarged partial view of the firing pin shown in FIGS. 2 and 3.
Figure 6:
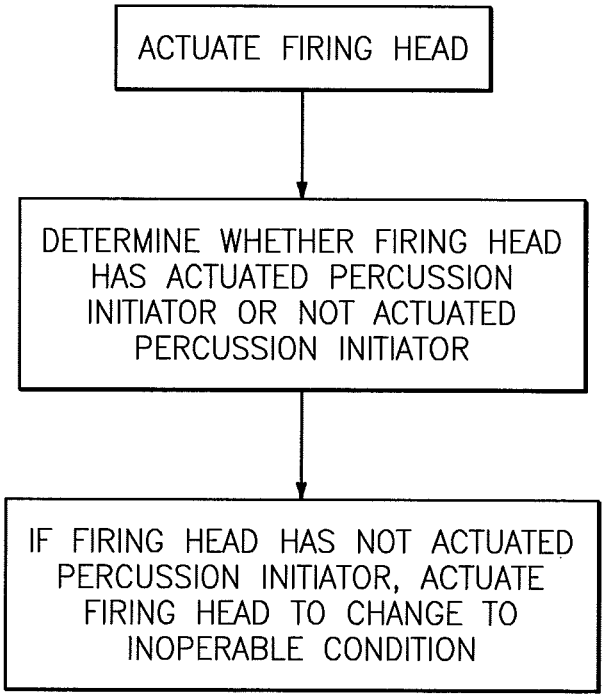
FIG. 6 is a block diagram of the operation of aspects of the present disclosure.

A non-limiting example of a percussion initiator 26 that can be used with the present disclosure firing head 20 is produced by the Fike Corporation of Blue Springs, Mo., USA. FIG. 4 illustrates an example of such a percussion initiator 26. The percussion initiator 26 includes a contact surface 62 having a depression 38 shaped to mate with and receive a protruding end surface 40 of a firing pin 24. In the example shown in FIG. 4, the contact surface depression 38 has a substantially-conical shape with an open end and a closed end 64. The closed end 64 configured with a radius "R"; i.e., the same radius, or nearly the same radius, as the distal end of the firing pin protruding end surface 40. The substantially-conical shape of the depression 38 has side walls that are disposed at an angle "α" relative to the centerline 66 of the substantially-conical shaped depression 38; i.e., conically oriented side walls disposed at the same angle, or nearly the same angle, as the substantially-conical shape exterior surface of the firing pin protruding end surface 40. Hence, the depression 38 and the firing pin 24 protruding end surface 40 have substantially mating surfaces. To be clear and as stated above, these mating geometries are examples of acceptable mating geometries, and the present disclosure is not limited thereto. Alternative mating geometries (e.g., a firing pin 24 having a female configuration used with a percussion initiator 26 having a contact surface with a male configuration) could be used.

Given an adequate amount of force, the mating geometries of the depression 38 and the protruding end surface 40 permit the impact of the firing pin 24 to cause the percussion initiator 26 to actuate. Absent the mating geometries, impact between the firing pin 24 and the percussion initiator 26 will not cause the percussion initiator 26 to actuate.

According to an aspect of the present disclosure, the present disclosure may include a firing head 20 having a firing pin 24 with a protruding end surface 40 comprising a degradable material that degrades (e.g., changes geometry) under certain well bore conditions (temperature, exposure to well bore fluids, etc.). In an initial non-degraded form, the firing pin protruding end surface 40 possesses a geometry that mates with the depression 38 of the percussion initiator 26 and therefore can cause actuation of the percussion initiator 26. However, the degraded form of the firing pin protruding end surface 40 geometry no longer mates with the depression 38 of the percussion initiator 26 and therefore cannot cause actuation of the percussion initiator 26. Hence, the firing head 20 (and therefore the perforating gun 18) of the TCP system 16 is rendered inoperable.

Figure 2:
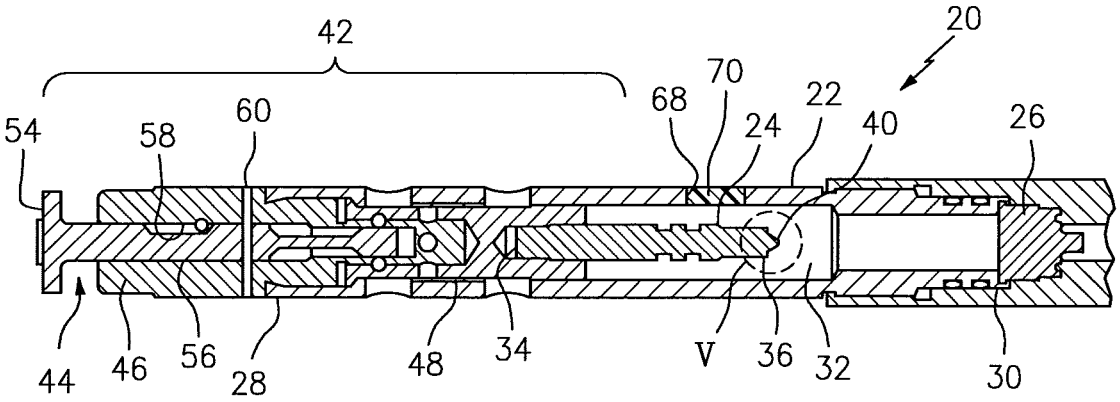
FIG. 2 is a diagrammatic sectional view of a firing head embodiment.
Figure 3:
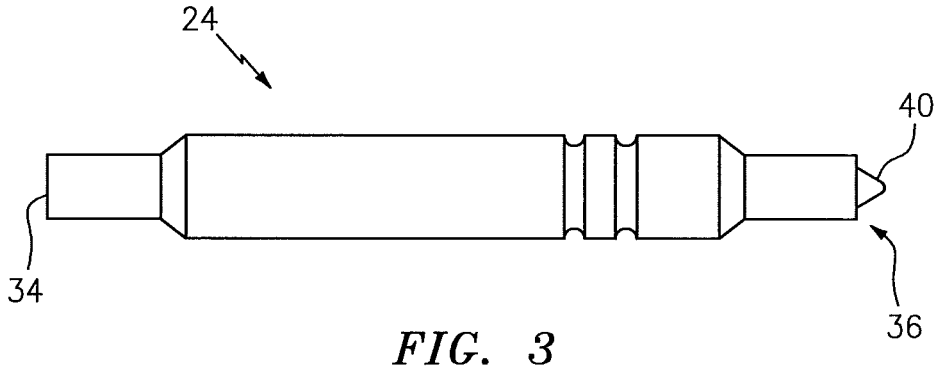
FIG. 3 is diagrammatic view of the firing pin shown in the firing head embodiment shown in FIG. 2.

The non-limiting firing head 20 embodiment shown in FIG. 2 includes a port 68 disposed in the firing head housing 22 that can expose the interior cavity 32 of the firing head housing 22 to well bore fluids under certain conditions. For example, as shown in FIG. 2, the port 68 may be initially sealed with a plug 70 to prevent exposure of the housing interior cavity 32 to well bore fluids present in the casing string 12. The plug 70 may be configured to open (e.g., by failure or other mode) under certain conditions. For example, the plug 70 may be configured such that an exterior pressure acting on the plug 70 above a certain predetermined pressure threshold will cause the plug 70 to rupture or dislodge and thereby allow well bore fluids to enter the housing interior cavity 32, or the plug 70 may be configured to perform as a valve that opens when subjected to a predetermined pressure threshold. As another example, the plug 70 may comprise a material that fails (e.g., dissolves, erodes, stress fractures, etc.) in the presence of well bore fluids after a determinable period of time, and thereby allows well bore fluids to enter the housing interior cavity 32. The present disclosure is not limited to these two examples of mechanisms that cause the housing interior cavity 32 to be exposed to well bore fluids under certain conditions.

In the operation of the present disclosure (e.g., see FIGS. 1-6), a TCP system 16 that utilizes a firing head 20 embodiment according to the present disclosure is inserted into the casing string 12 to a position where the operator desires to cause perforation of the casing string 12. A drop bar (not shown) is inserted into the casing string 12 to actuate the firing head 20. Under normal conditions, the drop bar acting on the firing head 20 causes the firing head 20 to actuate, which in turn causes the perforating gun 18 to actuate, and create the desired perforations in the casing string 12. In the event the firing head 20 does not actuate, or only partially actuates, there may be undetonated explosive material within the firing head 20. In some embodiments, the TCP system 16 may include a mechanism (e.g., acoustic sensors, electronic sensors, etc.) that can be used to make a determination regarding whether the firing head 20 has initiated, whether the firing head 20 has initiated the percussion initiator 26, etc. The present disclosure is not limited to any such mechanism.

Pursuant to the present disclosure and in the event the firing head 20 does not actuate the percussion initiator 26, the present disclosure provides a mechanism and/or methodology wherein the firing head 20 may be rendered inoperable within a useful period of time. For example, embodiments of present disclosure firing heads 20 may be configured to permit the ingress of well bore fluids into the housing interior cavity 32, thereby exposing the firing pin 24 to the well bore fluids; e.g., via a port disposed within the firing head housing. The well bore fluids, in turn, can within a useful period of time cause the firing pin 24 to degrade to an extent wherein the firing pin 24 is no longer configured in a form able to initiate the percussion initiator 26, thereby rendering the firing head 20 inoperable. As stated above, the specific mechanism by which the firing pin 24 degrades may vary depending upon the particular embodiment; e.g., the protruding end surface 40 of the firing pin 24 may dissolve, erode, or swell to a form wherein it no longer mates with a depression 38 formed in the percussion initiator 26; or the firing pin 24 may degrade such that it no longer possesses sufficient mechanical strength to actuate the percussion initiator 26, etc.

In some instances, it may be difficult to determine whether a firing head 20 has been completely actuated (e.g., if the TCP system 20 does not include a mechanism for determining whether the firing head 20 has initiated, whether the firing head 20 has initiated the percussion initiator 26, etc.) or undesirable to make such a determination. In those instances, or as a matter of regular course, a TCP system 16 according to the disclosure may be operated such that the firing head 20 is not removed from the well bore until the firing head 20 is known to be inoperable. For example, a TCP system 16 may include a firing head 20 that will become inoperable after a predetermined period of time within the well bore (e.g., a firing head housing having a port that permits an ingress of well bore fluids into the housing interior cavity 32, thereby exposing a firing pin 24 having a degradable material to the well bore fluids). In these instances, the firing head 20 is held within the well bore and only removed after the expiration of the predetermined amount of time. Hence, there is no need to determine if the firing head 20 has successfully actuated.

While various embodiments of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these features may be described individually, it is within the scope of the present disclosure that some or all of these features may be combined with any one of the aspects and remain within the scope of the present disclosure. Accordingly, the present disclosure is not to be restricted except in light of the attached claims and their equivalents.

What is claimed is:

1. A tubing conveying perforating system, comprising:

a perforating gun; and a firing head having a housing, a firing pin and a percussion initiator;

wherein the firing pin includes a protruding end surface that is configured to degrade over a predetermined period of time from an initial state configuration to a degraded state configuration, and the percussion initiator includes a depression; and wherein in the initial state configuration the protruding end surface is configured to be received within and mate with the depression in a first manner that permits actuation of the percussion initiator; and wherein in the degraded state configuration, the protruding end surface is configured to mate with the depression in a second manner that prevents actuation of the percussion initiator and renders the firing head inoperable.

2. The system of claim 1, wherein the predetermined period of time is no more than twenty-four hours.

3. The system of claim 2, wherein the predetermined period of time is no more than twelve hours.

4. The system of claim 3, wherein the protruding end surface is substantially conically shaped, and the depression is substantially conically shaped.

5. The system of claim 2, wherein the protruding end surface of the firing pin includes a material that degrades by dissolution when in contact with one or more well bore fluids, and the predetermined period of time begins when the protruding end surface of the firing pin is exposed to the one or more well bore fluids.

6. The system of claim 2, wherein the protruding end surface of the firing pin includes a material that degrades by erosion when in contact with one or more well bore fluids, and the predetermined period of time begins when the protruding end surface of the firing pin is exposed to the one or more well bore fluids.

7. The system of claim 2, wherein the protruding end surface of the firing pin includes a material that degrades by swelling when in contact with one or more well bore fluids, and the predetermined period of time begins when the protruding end surface of the firing pin is exposed to the one or more well bore fluids.

8. The system of claim 2, wherein the protruding end surface of the firing pin includes a material that degrades by undergoing a chemical change when in contact with one or more well bore fluids, and the predetermined period of time begins when the protruding end surface of the firing pin is exposed to the one or more well bore fluids.

9. The system of claim 2, wherein the protruding end surface of the firing pin includes a material that degrades by electrochemical reaction when in contact with one or more well bore fluids, and the predetermined period of time begins when the protruding end surface of the firing pin is exposed to the one or more well bore fluids.

10. The system of claim 1, wherein the housing includes a port that is selectively openable to an open configuration, and in the open configuration is configured to allow an ingress of well bore fluid into the housing and in communication with the protruding end surface of the firing pin.

11. A firing head, comprising:

a firing pin; and a percussion initiator;

wherein the firing pin includes a protruding end surface that is configured to degrade over a predetermined period of time from an initial state configuration to a degraded state configuration, and the percussion initiator includes a depression; and wherein in the initial state configuration the protruding end surface is configured to be received within and mate with the depression in a first manner that permits actuation of the percussion initiator; and wherein in the degraded state configuration, the protruding end surface is configured to mate with the depression in a second manner that prevents actuation of the percussion initiator and renders the firing head inoperable.

12. The firing head of claim 11, wherein the predetermined period of time is no more than twenty-four hours.

13. The firing head system of claim 12, wherein the predetermined period of time is no more than twelve hours.

14. The firing head of claim 12, wherein the protruding end surface of the firing pin includes a material that degrades by one or more of dissolution, erosion, swelling, chemical change, or electrochemical reaction when in contact with one or more well bore fluids, and the predetermined period of time begins when the protruding end surface of the firing pin is exposed to the one or more well bore fluids.

15. The firing head of claim 11, wherein the firing head further comprises a housing having an interior cavity and a port, and the firing pin and the percussion initiator are disposed within the interior cavity, and the port is actuable between a closed configuration wherein the interior cavity is sealed to prevent fluid entering the interior cavity, and an open configuration wherein the port permits ingress of fluid into the interior cavity, and the port is configured to change from the closed configuration to the open configuration upon exposure of the port to a predetermined pressure.

16. The system of claim 10, wherein the port is configured to change from a closed configuration to the open configuration upon exposure of the port to a predetermined pressure.

* * * * *